US008371698B2

(12) United States Patent
Brown

(10) Patent No.: US 8,371,698 B2
(45) Date of Patent: Feb. 12, 2013

(54) SCANNING PROJECTOR WITH VERTICAL INTERPOLATION ONTO HORIZONTAL TRAJECTORY

(75) Inventor: Margaret K. Brown, Seattle, WA (US)

(73) Assignee: Microvision, Inc., Redmond, WA (US)

( * ) Notice: Subject to any disclaimer, the term of this patent is extended or adjusted under 35 U.S.C. 154(b) by 416 days.

(21) Appl. No.: 12/758,593

(22) Filed: Apr. 12, 2010

(65) Prior Publication Data

US 2011/0249020 A1 Oct. 13, 2011

(51) Int. Cl.
*G09G 5/36* (2006.01)

(52) U.S. Cl. ..... 353/34; 353/70; 345/204; 345/606

(58) Field of Classification Search ..... 353/31, 353/34, 70, 85, 121, 122; 345/204, 545, 345/560, 606

See application file for complete search history.

(56) References Cited

U.S. PATENT DOCUMENTS

2007/0291051 A1* 12/2007 Brown et al. ..... 345/647

* cited by examiner

*Primary Examiner* — Kevin Pyo

(74) *Attorney, Agent, or Firm* — Kevin D. Wills

(57) ABSTRACT

A scanning projector includes a scanning mirror that sweep a beam in two dimensions. Source image data is interpolated vertically, and the results are stored in a frame buffer. Each row of the frame buffer holds vertically interpolated pixel data that lies on a trajectory corresponding to a horizontal sweep of the beam. Pixel data in each row is then interpolated to determine display pixel data. At least one light source is driven with the display pixel data to produce the beam that is reflected by the scanning mirror.

20 Claims, 15 Drawing Sheets

SCANNING PROJECTOR WITH VERTICAL INTERPOLATION ONTO HORIZONTAL TRAJECTORY

FIELD

The present invention relates generally to projection systems, and more specifically to scanning projection systems.

BACKGROUND

Scanning projectors typically scan a light beam in a raster pattern to project an image made up of pixels. The actual pixels displayed by the scanning projector lie on the scan trajectory of the raster pattern and may not coincide exactly with pixels in a source image.

DESCRIPTION OF EMBODIMENTS

Figure 1:
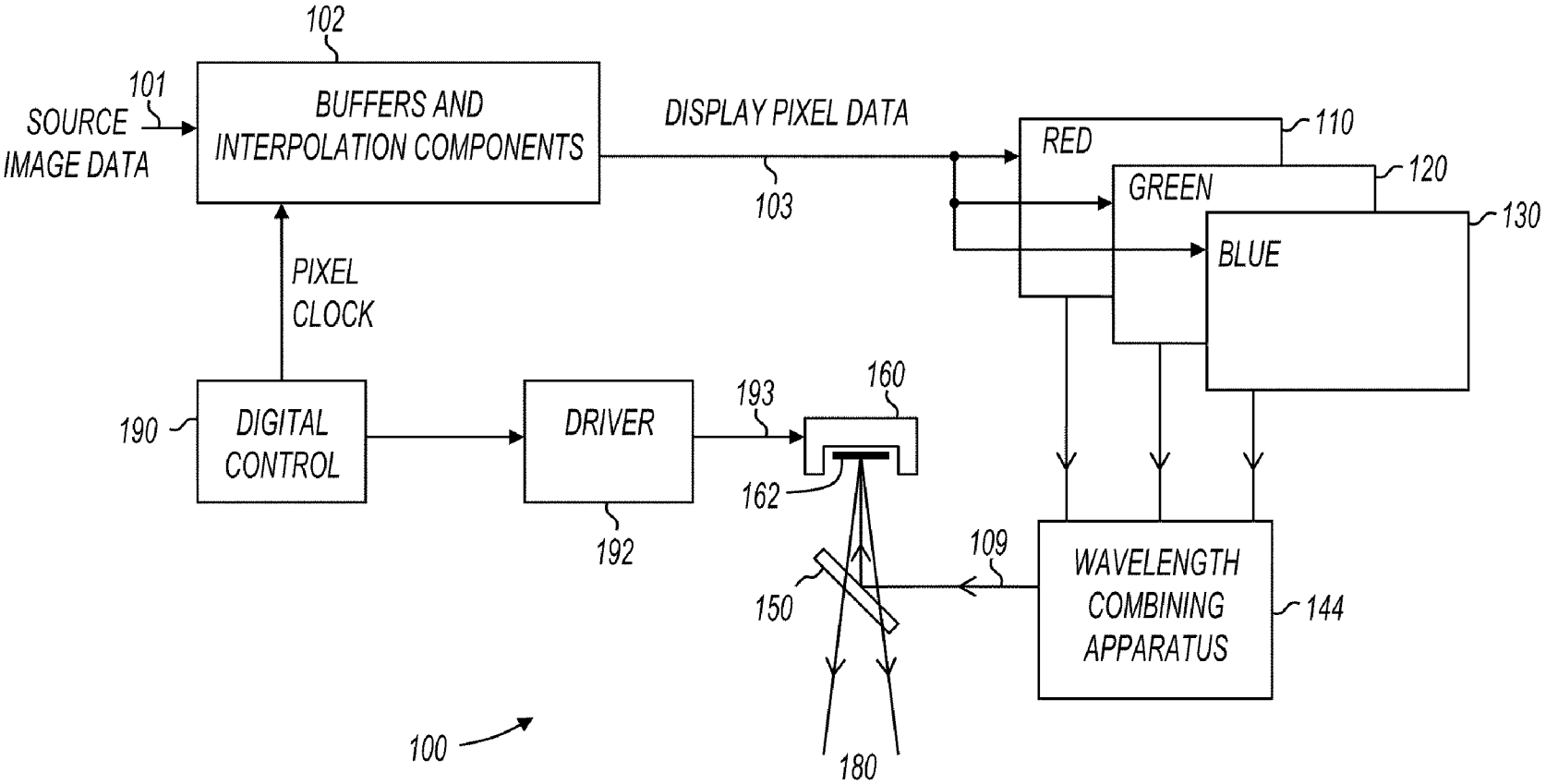
FIG. 1 shows a scanning projection apparatus in accordance with various embodiments of the present invention.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

FIG. 1 shows a scanning projection apparatus in accordance with various embodiments of the present invention. Apparatus 100 includes buffers and interpolation components 102, light sources 110, 120, and 130, wavelength combining apparatus 144, fold mirror 150, micro-electronic machine (MEMS) device 160 having scanning mirror 162, MEMS driver 192, and digital control component 190.

In operation, buffers and interpolation components 102 receives source image data on node 101, receives a pixel clock from digital control component 190, and produces display pixel data to drive the light sources when pixels are to be displayed. The source image data 101 is typically received with pixel data on a rectilinear grid, but this is not essential. For example, source image data 101 may represent a grid of pixels at any resolution (e.g., 640×480, 848×480, 1920×1080). Scanning projection apparatus 100 scans a raster pattern that does not necessarily align with the rectilinear grid in the image source data, and buffers and interpolation components 102 operate to produce display pixel data that will be displayed at appropriate points on the raster pattern.

Light sources 110, 120, and 130 receive display pixel data and produce light having grayscale values in response thereto. Light sources 110, 120, and 130 are shown as red, blue, and green light sources, but this is not necessarily a limitation of the present invention. For example, any number of different color light sources (including only one) may be included, and they may be any color. Further, the light produced may be visible or nonvisible. For example, in some embodiments, one or more of light sources 110, 120, and 130 may produce infrared (IR) light.

In some embodiments, light sources 110, 120, and 130 may be laser light producing devices. For example, in some embodiments, the light sources may include laser diodes. In these embodiments, the light sources also include driver circuits that accept the display pixel values and produce current signals to drive the laser diodes. Each light source produces a narrow beam of light which is directed to wavelength combining apparatus 144. Wavelength combining apparatus 144 may include any suitable hardware to combine light of different wavelengths into a single color beam. For example, wavelength combining apparatus 144 may include dichroic mirrors or any other suitable optical elements.

The combined light produced by wavelength combining apparatus 144 at 109 is reflected off fold mirror 150 on its way to scanning mirror 162. The scanning mirror moves on two axes in response to electrical stimuli received on node 193 from MEMS driver 192. After reflecting off scanning mirror 162, the laser light bypasses fold mirror 150 to sweep a raster pattern and create an image at 180.

The shape of the raster pattern swept by scanning mirror 162 is a function of the mirror movement on its two axes. For example, in some embodiments, scanning mirror 162 sweeps in a first dimension (e.g., vertical dimension) in response to triangle wave stimulus, resulting in a substantially linear and bidirectional vertical sweep. Also for example, in some embodiments, scanning mirror 162 sweeps in a second dimension (e.g., horizontal dimension) according to a sinusoidal stimulus, resulting in a substantially sinusoidal horizontal sweep. In these embodiments, the resulting two-dimensional raster pattern of the reflected light beam does not pass through each and every pixel in the source image data.

In some embodiments, buffers and interpolation components 102 interpolates vertically and places the results in rows of a frame buffer. Each row in the frame buffer corresponds to pixels that lie on one horizontal sweep of the scan trajectory. For example, in embodiments having a sinusoidal horizontal trajectory, each row in the frame buffer corresponds to a portion of one cycle of the sinusoid. Buffers and interpolation components 102 then interpolate within rows of the frame buffer to determine display pixel values at times specified by the pixel clock. The display pixel data is then provided to the light sources 110, 120 and 130.

Source image data 101 may represent a still picture, multiple still pictures, or a video stream. The various embodiments of the present invention are described herein as if source image data 101 is a still picture or a single frame of video; however, this is not to be construed as a limitation of the present invention. In some embodiments, scanning projection system 100 operates continuously on streaming video that includes multiple frames in sequence.

The MEMS based projector is described as an example application, and the various embodiments of the invention are not so limited. For example, the buffers and interpolation components described herein may be used with other optical systems without departing from the scope of the present invention.

Figure 2:
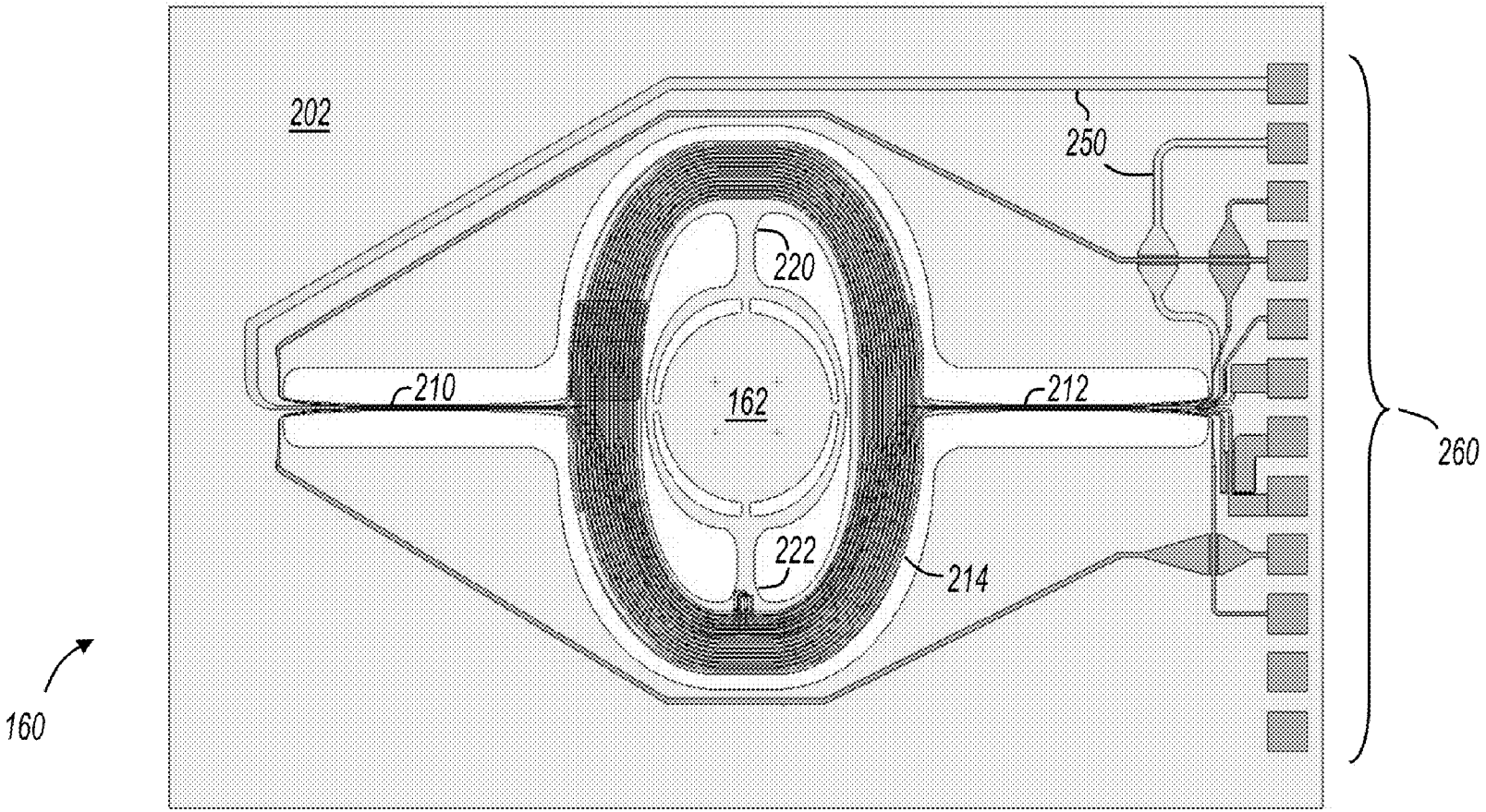
FIG. 2 shows a plan view of a microelectromechanical system (MEMS) device with a scanning mirror.

FIG. 2 shows a plan view of a microelectromechanical system (MEMS) device with a scanning mirror. MEMS device 160 includes fixed platform 202, scanning platform 214 and scanning mirror 162. Scanning platform 214 is coupled to fixed platform 202 by flexures 210 and 212, and scanning mirror 162 is coupled to scanning platform 214 by flexures 220 and 222. Scanning platform 214 has a drive coil connected to drive lines 250. Current driven into drive lines 250 produces a current in the drive coil. Two of the interconnects 260 are coupled to drive lines 250.

In operation, an external magnetic field source (not shown) imposes a magnetic field on the drive coil. The magnetic field imposed on the drive coil by the external magnetic field source has a component in the plane of the coil, and is oriented non-orthogonally with respect to the two drive axes. The in-plane current in the coil windings interacts with the in-plane magnetic field to produce out-of-plane Lorentz forces on the conductors. Since the drive current forms a loop on scanning platform 214, the current reverses sign across the scan axes. This means the Lorentz forces also reverse sign across the scan axes, resulting in a torque in the plane of and normal to the magnetic field. This combined torque produces responses in the two scan directions depending on the frequency content of the torque.

Scanning platform 214 moves relative to fixed platform 202 in response to the torque. Flexures 210 and 220 are torsional members that twist as scanning platform 214 undergoes an angular displacement with respect to fixed platform 202. In some embodiments, scanning mirror 162 moves relative to scanning platform 214 at a resonant frequency, although this is not a limitation of the present invention.

The long axis of flexures 210 and 212 form a pivot axis. Flexures 210 and 212 are flexible members that undergo a torsional flexure, thereby allowing scanning platform 214 to rotate on the pivot axis and have an angular displacement relative to fixed platform 202. Flexures 210 and 212 are not limited to torsional embodiments as shown in FIG. 2. For example, in some embodiments, flexures 210 and 212 take on other shapes such as arcs, "S" shapes, or other serpentine shapes. The term "flexure" as used herein refers to any flexible member coupling a scanning platform to another platform (scanning or fixed), and capable of movement that allows the scanning platform to have an angular displacement with respect to the other platform.

The particular MEMS device embodiment shown in FIG. 2 is provided as an example, and the various embodiments of the invention are not limited to this specific implementation. For example, any scanning mirror capable of sweeping in two dimensions to reflect a light beam in a raster pattern may be incorporated without departing from the scope of the present invention.

Figure 3:
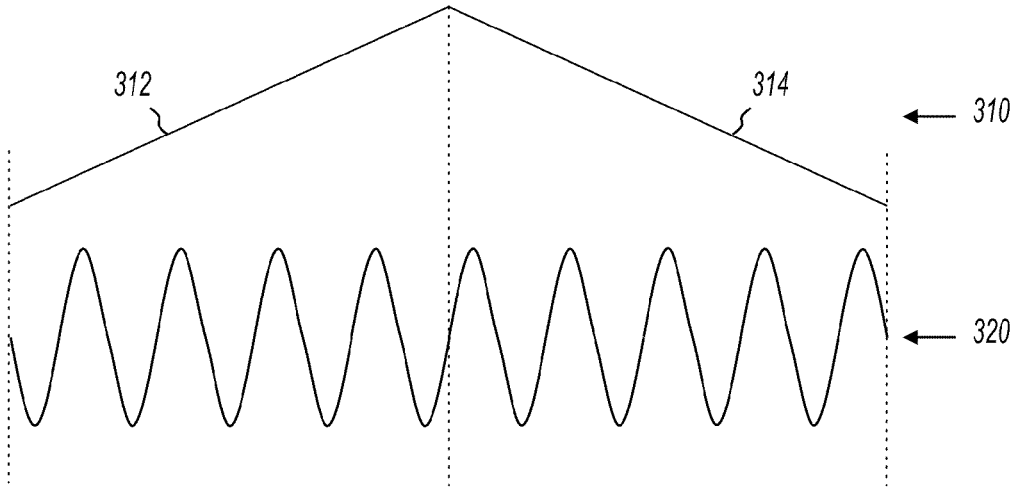
FIG. 3 shows deflection waveforms resulting from a linear vertical trajectory and a sinusoidal horizontal trajectory.

FIG. 3 shows example waveforms suitable for the operation of the projection system of FIG. 1. Vertical deflection waveform 310 is a triangular waveform, and horizontal deflection waveform 320 is a sinusoidal waveform. When mirror 162 is deflected on its vertical and horizontal axes according to the waveforms 310 and 320, the scanned beam trajectory shown in FIG. 4 results. In some embodiments, pixels are painted as the beam sweeps from top-to-bottom as well as from bottom-to-top. For example, during the rising portion 312 of the vertical triangular waveform, the beam sweeps trajectory 400 (FIG. 4) from top-to-bottom (460), and during falling portion 314, the beam sweeps trajectory 400 (or a different trajectory) from bottom-to-top (410).

Deflection of mirror 162 according to waveforms 310 and 320 may be achieved by driving MEMS device 160 with the appropriate drive signals. In some embodiments, the horizontal deflection frequency is at a resonant frequency of the mirror and a very small excitation at that frequency will result in the desired deflection. A triangular drive signal for the vertical deflection may be derived from a sum of sine waves at various frequencies. In some embodiments excitation signals for both dimensions are combined into a single drive signal to drive a coil on a scanning platform (214, FIG. 2).

Figure 4:
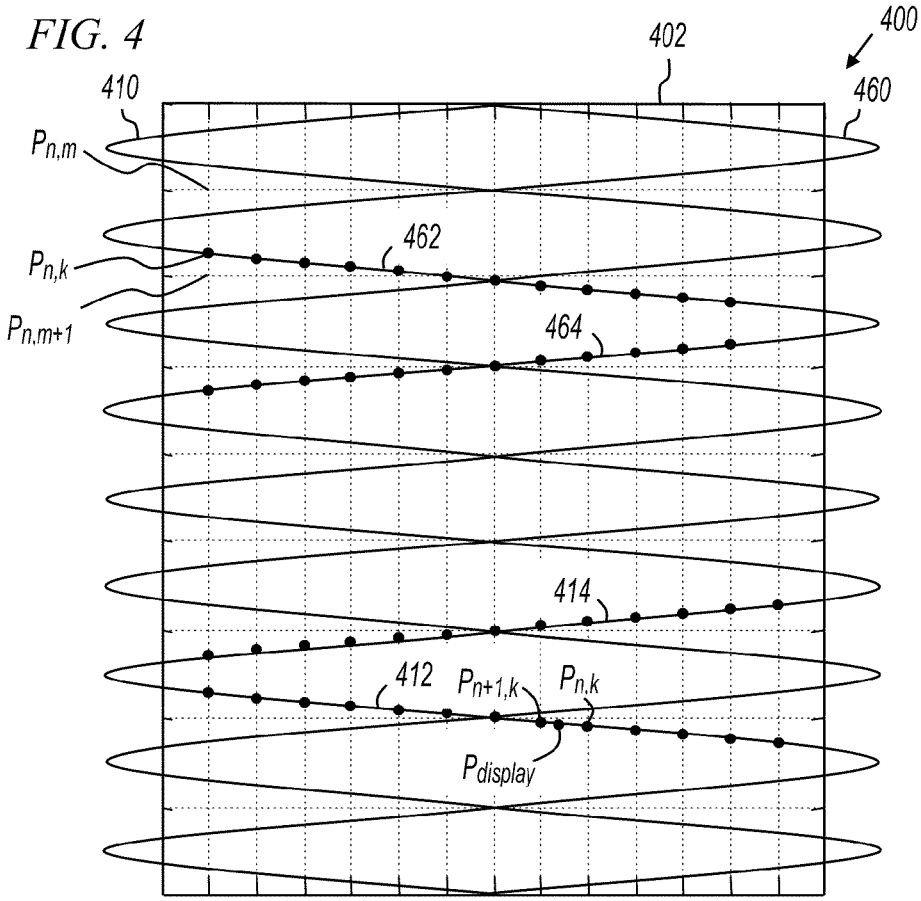
FIG. 4 shows a scan trajectory having a sinusoidal horizontal component and a linear vertical component.

FIG. 4 shows a scan trajectory having a sinusoidal horizontal component and a linear vertical component. Scan trajectory 400 corresponds to the vertical mirror deflection and horizontal mirror deflection shown in FIG. 3. Scan trajectory 400 is shown superimposed upon a grid 402. Grid 402 represents rows and columns of pixels that make up a source image. For example, grid 402 may represent rows and columns of pixels in source image data 101 (FIG. 1). The rows of pixels are aligned with the horizontal dashed lines, and columns of pixels are aligned with the vertical dashed lines. The image is made up of pixels that occur at the intersections of dashed lines. On scan trajectory 400, the beam sweeps back and forth left to right in a sinusoidal pattern, and sweeps vertically at a substantially constant rate.

The pixels actually displayed (or "painted") by the projection system may not correspond to the pixel locations in the source image data. For example, pixels are displayed at times specified by the pixel clock as the beam sweeps scan trajectory 400. Various embodiments of the present invention interpolate between pixels in the source image data to determine appropriate values for pixels that are actually displayed. For example, in some embodiments, the projection system interpolates the source image data vertically to create pixel data that lies on the trajectories of the horizontal sweeps. This pixel data is stored in rows of a frame buffer where each row holds pixel data on one horizontal sweep. Pixel data in each row of the frame buffer is then interpolated to determine display pixel values that will be used to drive the light sources.

As shown in FIG. 4, scan trajectory 400 includes multiple horizontal sweeps. For example, horizontal sweeps 462 and 464 are traversed when the scan trajectory is sweeping vertically from top-to-bottom, and horizontal sweeps 412 and 414 are traversed when the scan trajectory is sweeping from bottom-to-top. The pixels shown on the horizontal sweeps 462 and 464 are neither pixels from the source image, nor pixels that will be displayed. Rather, these pixels are the result of vertical interpolation, and are stored in the frame buffer. This is described in further detail below with reference to later figures.

In some embodiments, the vertical sweep rate is set such that the number of horizontal sweeps has a fixed relationship to the number of rows in the grid. For example, as shown in FIG. 4, each horizontal sweep from left to right may corresponds to one row in the grid and the following sweep from right to left may correspond to the next row. In other embodiments, the vertical sweep rate is independent of, and not related to, the number of rows in the grid. For example, in some embodiments, the source image data may include any resolution whereas the vertical and horizontal sweep rates may be fixed.

A reduced number of pixels are intentionally shown in grid 402 for ease of explanation. In some embodiments, the scanning projection device 100 (FIG. 1) supports substantially larger source images with many more pixels than shown in FIG. 4.

Figure 5:
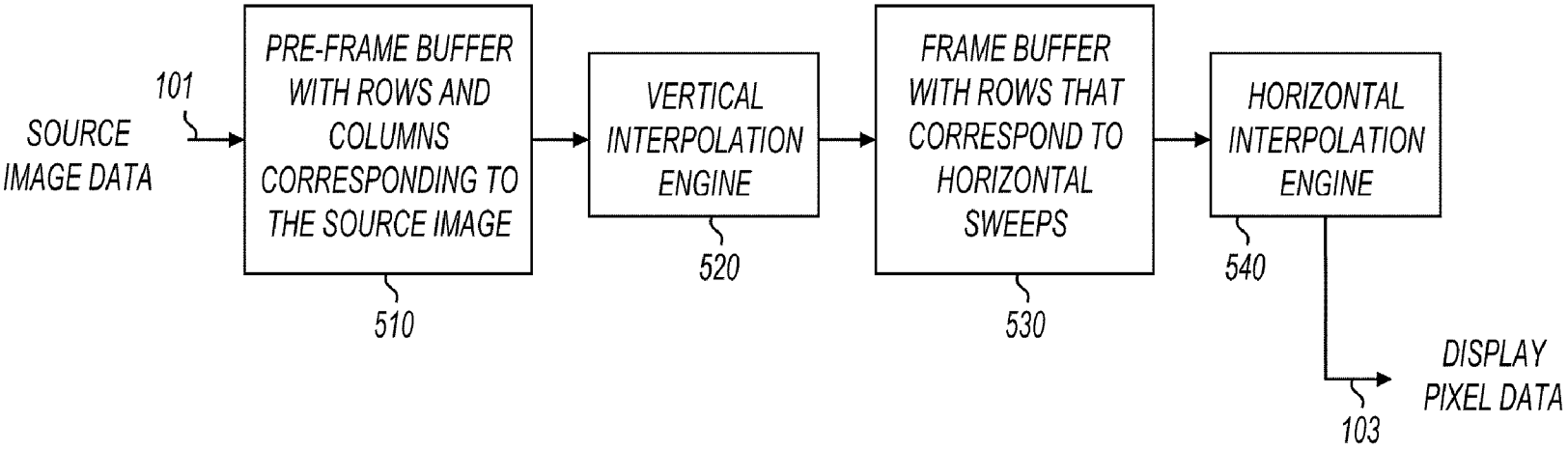
FIGS. 5-7 show buffers and interpolation components in accordance with various embodiments of the present invention.
Figure 6:
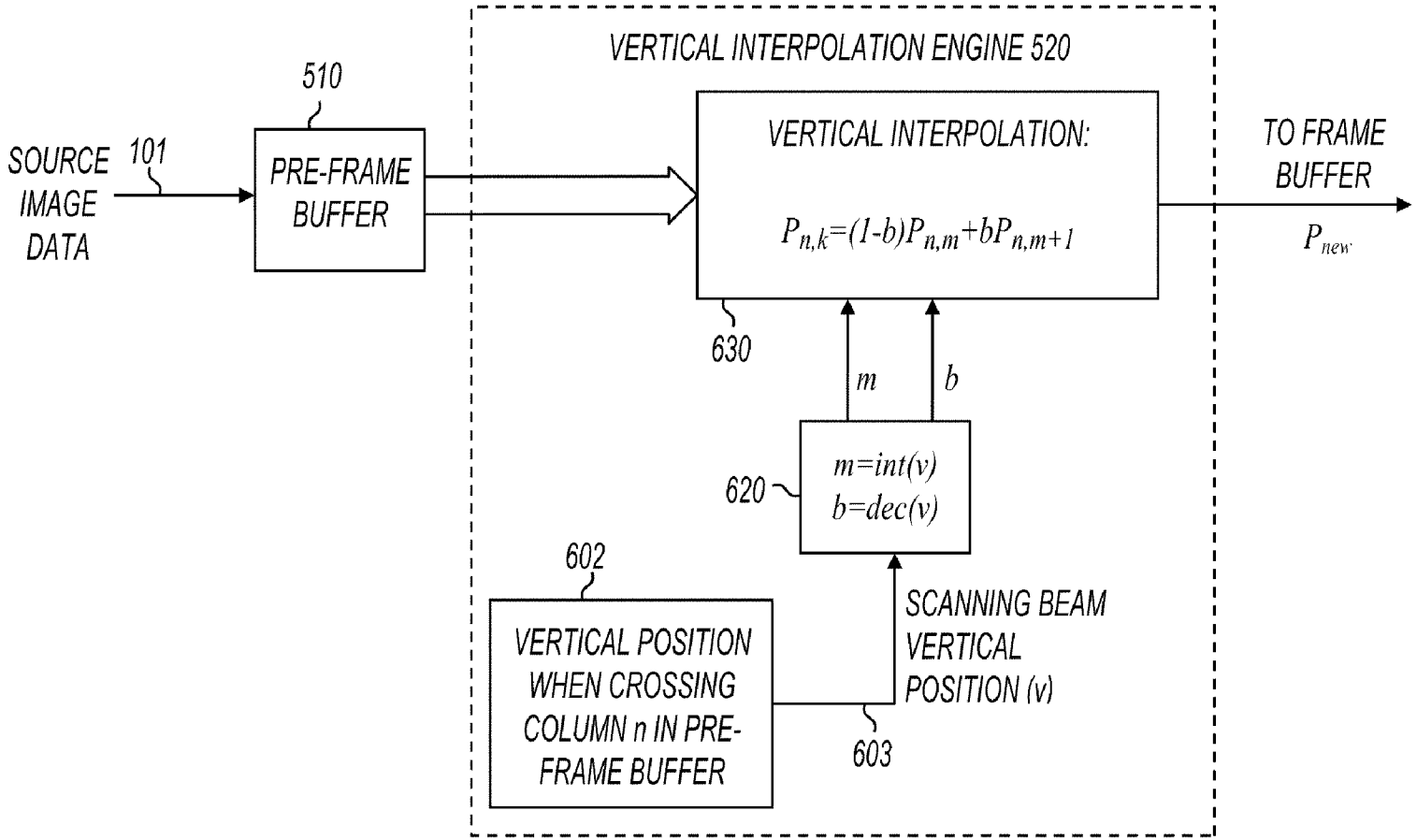
Figure 7:
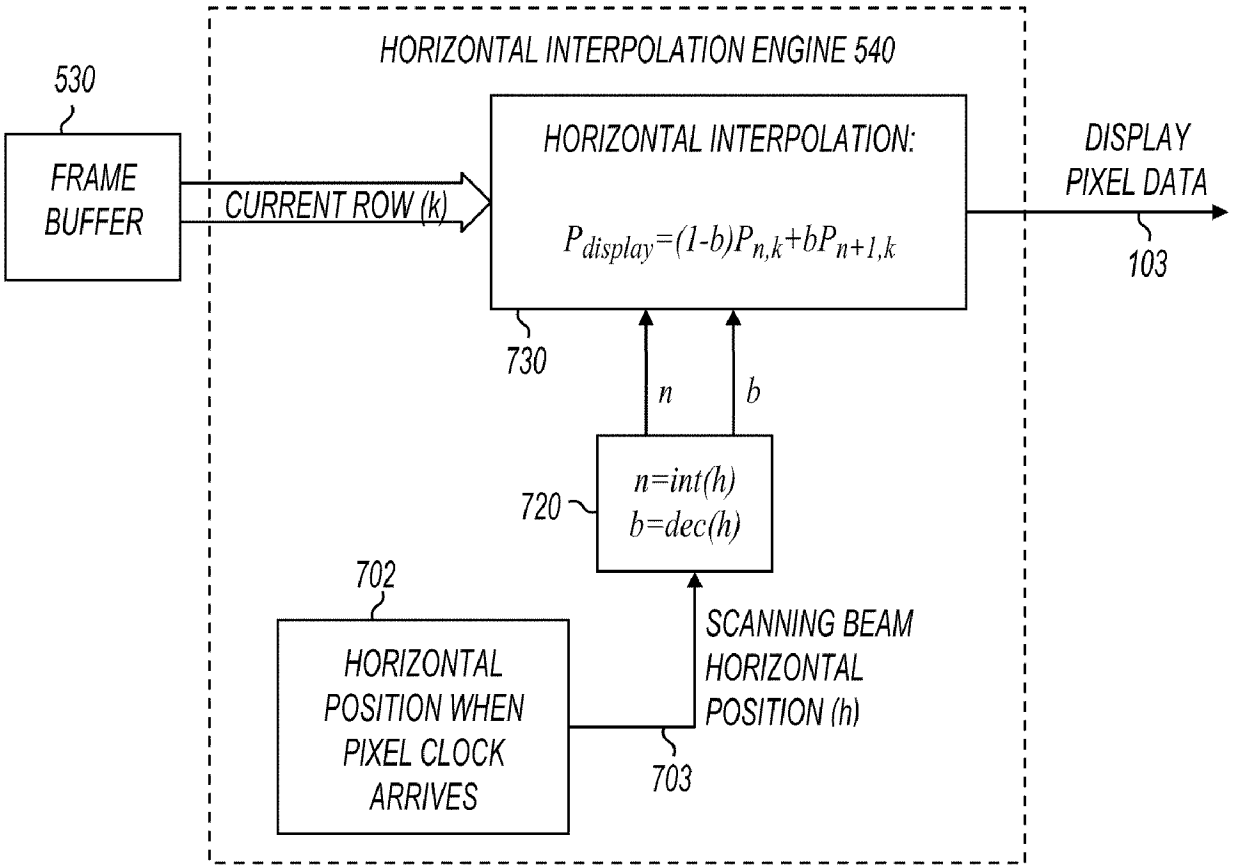

FIGS. 5-7 show buffers and interpolation components in accordance with various embodiments of the present invention. FIG. 5 shows pre-frame buffer 510, vertical interpolation engine 520, frame buffer 530, and horizontal interpolation engine 540.

In operation, pre-frame buffer 510 receives source image data 101. Pre-frame buffer includes rows and columns of storage that correspond to pixels in the source image. For example, referring now back to FIG. 4, pre-frame buffer 510 includes storage for each pixel that resides at the intersections of the dashed lines in grid 402. In some embodiments, the source image data includes multiple frames of video data. In these embodiments, pre-frame buffer 510 holds one image, or "frame" of the video data at a time. Also in some embodiments, pre-frame buffer 510 is continuously updated as video data arrives, and data is retrieved from pre-frame buffer 510 at a rate that allows entire frames to be retrieved before they are overwritten.

Vertical interpolation engine 520 interpolates pixel data within individual columns of the source image to determine pixel values that lie on horizontal sweeps of the scan trajectory. For example, referring now back to FIG. 4, vertical interpolation engine 520 interpolates between $P_{n,m}$ and $P_{n,m+1}$ to determine the value of pixel $P_{n,k}$ within horizontal sweep 462, where n is the source image pixel column number, and m is the source image pixel row number, and k is the frame buffer row number. FIG. 4 shows vertical interpolation between two vertically adjacent pixels, although the present invention is not so limited. For example, any interpolation algorithm may be employed, including an interpolation algorithm that interpolates using more than two pixels.

Vertical interpolation engine 520 determines pixel values for each horizontal sweep of the scan trajectory and then deposits those pixel values in frame buffer 530. For example, the remaining pixels shown on horizontal sweep 462 are determined and deposited in one row of frame buffer 530. Likewise, the pixels shown on horizontal sweep 464 are determined and deposited in another row of frame buffer 530.

In some embodiments, vertical interpolation engine 520 interpolates pixel data for multiple vertical sweeps during one traversal of the pre-frame buffer. For example, vertical interpolation engine 520 may traverse the source image data from top-to-bottom, while interpolating pixel values for horizontal scan trajectories that will be painted top-to-bottom and bottom-to-top. Referring now back to FIG. 4, trajectory 460 is top-to-bottom, and trajectory 410 is bottom-to-top. Vertical interpolation engine 520 may interpolate for both of these trajectories while traversing the source image data once. This allows fewer accesses into pre-frame buffer 510 by vertical interpolation engine 520 than if each vertical sweep were vertically interpolated separately.

Frame buffer 530 includes rows that hold pixel data corresponding to horizontal sweeps of the scan trajectory. For example, one row of frame buffer 530 holds pixel data corresponding to horizontal sweep 462, and another row of frame buffer 530 holds pixel data corresponding to horizontal sweep 464. Accordingly, the term "row" when used in the context of frame buffer 530 refers to a "row" of pixels on a horizontal sweep, and not necessarily to a row of pixels in the source image.

Horizontal interpolation engine 540 retrieves row data from frame buffer 530, and interpolates within the row to determine display pixel data. For example, referring now back to FIG. 4, horizontal interpolation engine 540 interpolates between $P_{n,k}$ and $P_{n+1,k}$ within horizontal sweep 412 to determine the value of pixel $P_{display}$, where n is the frame buffer column number, and k is the frame buffer row number. FIG. 4 shows horizontal interpolation between two horizontally adjacent pixels, although the present invention is not so limited. For example, any interpolation algorithm may be employed, including an interpolation algorithm that interpolates using more than two pixels.

The various components in FIG. 5 may be implemented in any manner without departing from the scope of the present invention. For example, pre-frame buffer 510 and frame buffer 530 may be memory devices such as random access memory. Also for example, interpolation engines 520 and 540 may be implemented in hardware, software, or any combination. The various components may utilize processors, application specific integrated circuits (ASICs), or any other suitable means for implementing the functions described herein.

In some embodiments, the different interpolation operations may be performed at different times. For example, vertical interpolation engine 510 may interpolate and fill frame buffer 530 when a video frame arrives, and horizontal interpolation engine 540 may interpolate only as display pixel values are needed as specified by the pixel clock. The pixel clock may or may not be periodic, and the displayed pixels may be dispersed linearly or nonlinearly along any one horizontal sweep. For example, because in some embodiments the horizontal sinusoidal trajectory sweeps faster in the center than at either the left or right sides, a linear pixel clock that displays at least one pixel per column near the horizontal center will display more than one pixel per column near the left and right sides. In some embodiments, the pixel clock and sweep frequencies are timed to display about two pixels per frame buffer column in the center, and about eight or more pixels per frame buffer column near the left and right sides. Further, a nonlinear pixel clock may be provided to display a substantially fixed number of pixels per frame buffer column regardless of the nonlinear nature of the horizontal sweep. Interpolation between frame buffer pixels allows the pixel clock to "land" anywhere between pixels within the frame buffer row while still displaying the correct intensity.

FIG. 6 shows vertical interpolation engine 520 in more detail. Vertical position determination component 602 determines the vertical position within a horizontal sweep of the scan trajectory when crossing column n in the pre-frame buffer. For example, referring now back to FIG. 4, component 602 determines the vertical (v) position of $P_{n,k}$. Vertical position determination component 602 may determine the vertical position in any manner. For example, in some embodiments, a look up table may be maintained that lists vertical position as a function of time.

At 620, the vertical position is decomposed to its integer portion (m) and decimal portion (b), where the integer portion corresponds to a source image row number, and the decimal portion corresponds to a fractional distance between source image rows. The integer portion is used to fetch pixels from the appropriate rows of the pre-frame buffer, and the decimal portion is used to weight the pixels during interpolation as shown in FIG. 6. The interpolation shown in FIG. 6 is an example of linear interpolation between two pixels, but this is not a limitation of the present invention. Any number of pixels may be fetched from pre-frame buffer 510, and any interpolation algorithm may be used to arrive at the value of $P_{n,k}$.

FIG. 7 shows horizontal interpolation engine 540 in more detail. Horizontal position determination component 702 determines the horizontal position within a horizontal sweep of the scan trajectory when a pixel clock arrives. For example, referring now back to FIG. 4, component 702 determines the horizontal (h) position of $P_{display}$. At 720, the horizontal position is decomposed to its integer portion (n) and decimal portion (b), where the integer portion corresponds to a column number in the frame buffer, and the decimal portion corresponds to a fractional distance between frame buffer columns. The integer portion is used to fetch pixels from the current row (k) of the frame buffer, and the decimal portion is used to weight the pixels during interpolation as shown in FIG. 7. The interpolation shown in FIG. 7 is an example of linear interpolation between two pixels, but this is not a limitation of the present invention. Any number of pixels may be fetched from the current row (k) of frame buffer 510, and any interpolation algorithm may be used to arrive at the value of $P_{display}$.

Figure 8:
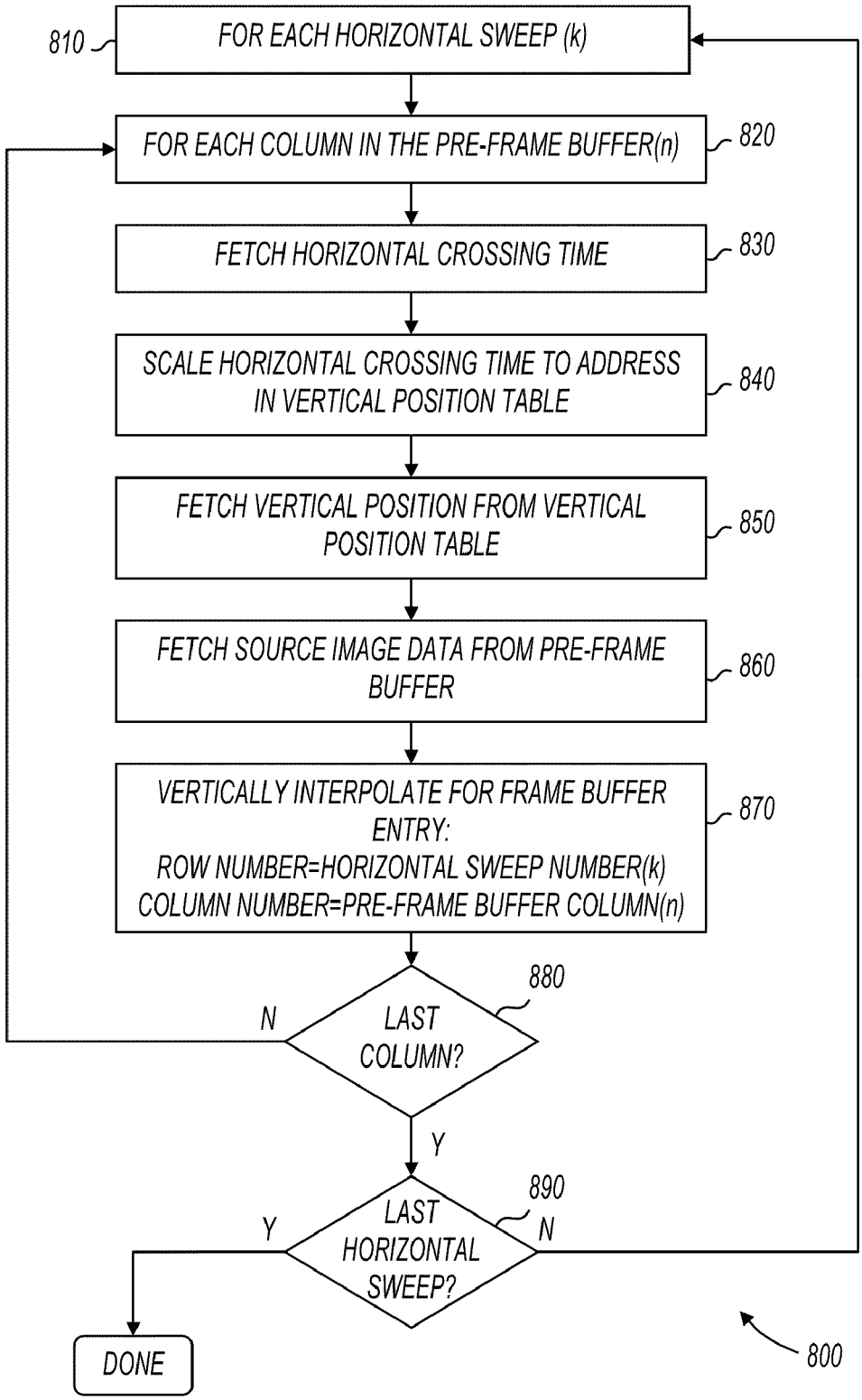
FIGS. 8 and 9 show flow diagrams of methods in accordance with various embodiments of the present invention.

FIG. 8 shows a flow diagram of methods in accordance with various embodiments of the present invention. In some embodiments, method 800, or portions thereof, is performed by a scanning laser projector, embodiments of which are shown in previous figures. In other embodiments, method 800 is performed by a series of circuits or an electronic system. Method 800 is not limited by the particular type of apparatus performing the method. The various actions in method 800 may be performed in the order presented, or may be performed in a different order. Further, in some embodiments, some actions listed in FIG. 8 are omitted from method 800.

Method 800 is shown beginning with block 810. As shown at 810, the actions between 810 and 890 are performed for each horizontal sweep (k) of the raster trajectory. As shown at 820, the actions between 820 and 880 are performed for each column in the pre-frame buffer. At 830, the time at which the horizontal sweep crosses the current pre-frame buffer column is determined. In some embodiments, this can simply be fetched from a table that has precomputed values. In other embodiments, this horizontal crossing time is computed on the fly. In embodiments with a sinusoidal horizontal trajectory, the horizontal crossing time may be computed with an arcsine function.

At 840, the horizontal crossing time is scaled to an address in a vertical position table, and at 850, the vertical position is fetched from the vertical position table. As shown in FIG. 8, in some embodiments, the vertical position may be precomputed and stored in look up tables for fast access. In other embodiments, the vertical position may be computed on the fly. The actions of 830, 840, and 850 correspond to the actions of component 602 (FIG. 6). At the completion of 830, 840, and 850, the vertical position (v) of the current horizontal sweep (k) at the current column (n) is known.

At 860, source image data is fetched from the pre-frame buffer. The source image data fetched from the pre-frame buffer is from a common column (n). Any number of pixels from column (n) may be fetched for use in vertical interpolation. At 870, a frame buffer entry is determined by vertically interpolating pixel data from a single column of the pre-frame buffer. The frame buffer entry row number is the horizontal sweep number (k), and the frame buffer column number is the same as the pre-frame buffer column number (n).

Each time the inquiry at 880 is satisfied, one row of the frame buffer has been filled with pixel data that lies on a single horizontal sweep. Further, when the inquiry at 890 is satisfied, every row of the frame buffer has been filled, and the vertical interpolation is complete.

In some embodiments, method 800 performs vertical interpolation for multiple vertical sweeps. For example, referring now back to FIG. 4, trajectories 410 and 460 represent two separate vertical sweeps of the scan trajectory while painting the same image. Method 800 may vertically interpolate for both trajectories while traversing the pre-frame buffer once to reduce the number of pre-frame buffer accesses required. Further, in some embodiments, more than two vertical sweeps may be vertically interpolated for each traversal of the pre-frame buffer. (See FIG. 10).

Figure 9:
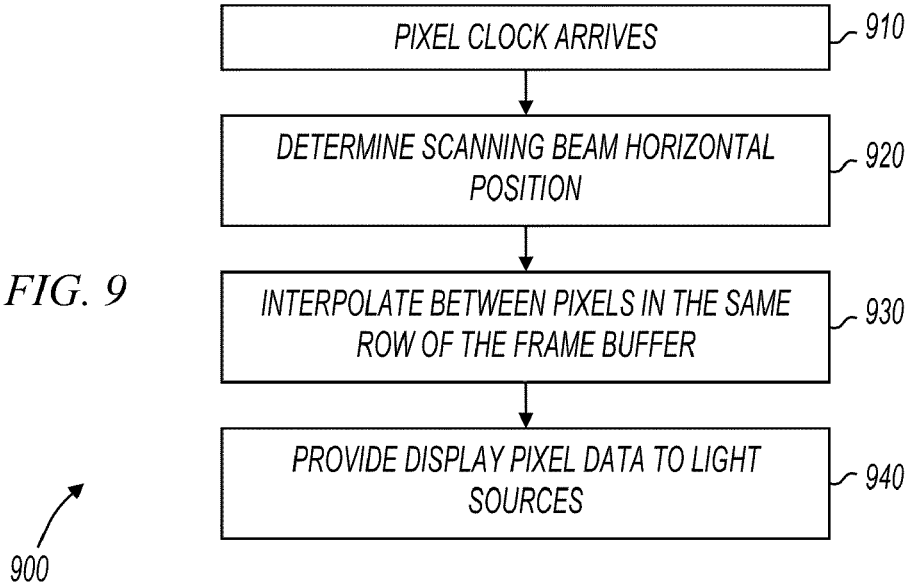

FIG. 9 shows a flow diagram of methods in accordance with various embodiments of the present invention. In some embodiments, method 900, or portions thereof, is performed by a scanning laser projector, embodiments of which are shown in previous figures. In other embodiments, method 900 is performed by a series of circuits or an electronic system. Method 900 is not limited by the particular type of apparatus performing the method. The various actions in method 900 may be performed in the order presented, or may be performed in a different order. Further, in some embodiments, some actions listed in FIG. 9 are omitted from method 900.

Method 900 is shown beginning with block 910 when a pixel clock arrives. This corresponds to a time at which a display pixel is to be displayed. At 920, the horizontal position of the scanning beam is determined. This corresponds to the operation of component 702 (FIG. 7). The horizontal position may be precomputed and stored in a table for fast lookup, or may be computed on the fly.

At 930, method 900 interpolates between pixels in the same row of the frame buffer. The current row (k) of the frame buffer corresponds to the current horizontal sweep. The actions of 930 correspond to the operation of component 730 (FIG. 7). Although linear interpolation is shown at 730, this is not a limitation of the present invention. Any number of pixels may be fetched from the current frame buffer row for interpolation, and any interpolation algorithm may be used. At 940, the display pixel data is provided to the light sources. This corresponds to display pixel data 103 being provided to light sources 110, 120, and 130 (FIG. 1).

Multiple instantiations of buffers and interpolation components 102 (FIG. 1) may exist. For example, in embodiments with three different light sources, one instantiation of buffers and interpolation components 102 may exist for each light source. In some embodiments, only portions of buffers and interpolation components 102 are duplicated for each light source. For example, the horizontal and vertical position determination may be common for every light source, whereas pre-frame buffers and frame buffers may include separate storage for each light source.

Figure 10:
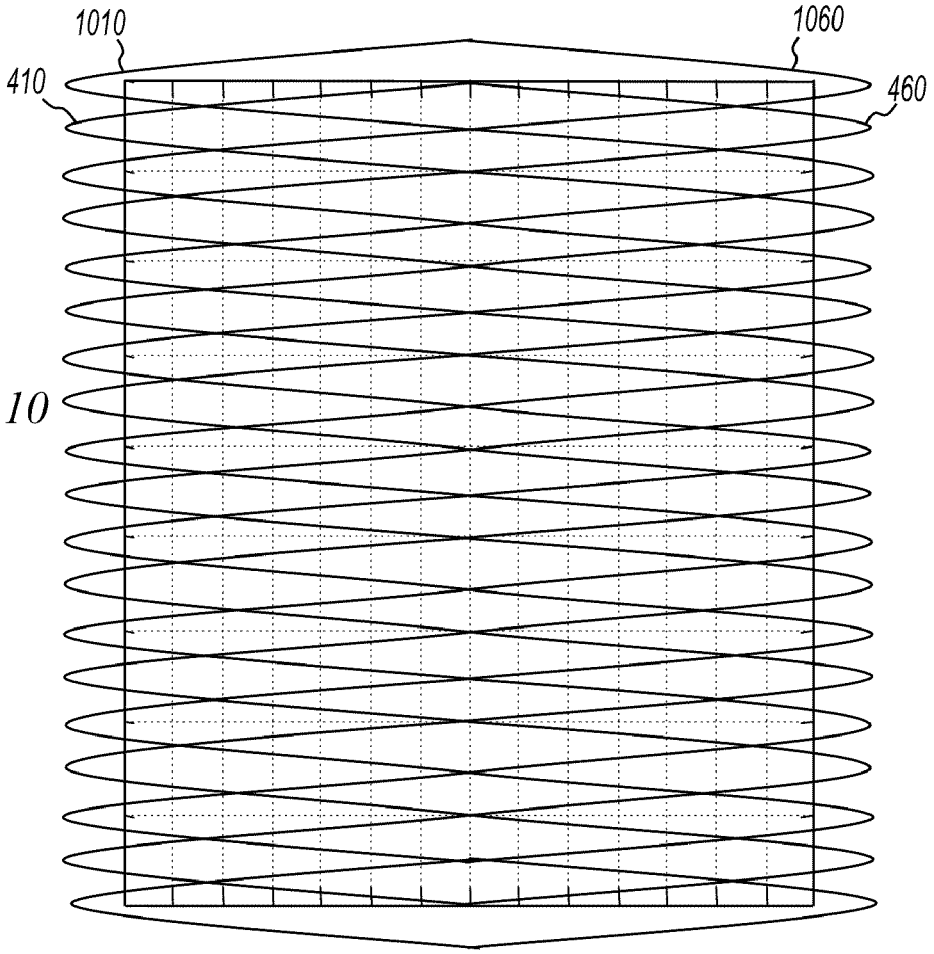
FIG. 10 shows multiple scan trajectories with phase offsets.

FIG. 10 shows multiple scan trajectories with phase offsets. FIG. 10 shows vertical trajectories 410 and 460 which are also shown in FIG. 4 and described with reference thereto. FIG. 10 also shows vertical trajectories 1010 and 1060. In some embodiments, the scanning beam traverses all four of these trajectories for each image or video frame. For example, for a 60 Hz video frame rate, the vertical sweep rate may be set such that four vertical sweeps occur 60 times each second.

Any amount of phase offset may occur between successive vertical sweeps. For example, as shown in FIG. 10, phase offsets may be introduced that cause the scan trajectory to not repeat for multiple vertical sweeps, thereby "filling in" more areas within the display area with display pixels.

In some embodiments, vertical interpolation may be performed for many vertical sweeps for one traversal of the pre-frame buffer. For example, when multiple vertical sweeps occur for each video frame as in FIG. 10, the various embodiments of the present invention may vertically interpolate for all vertical sweeps during a single traversal of the pre-frame buffer.

Figure 11:
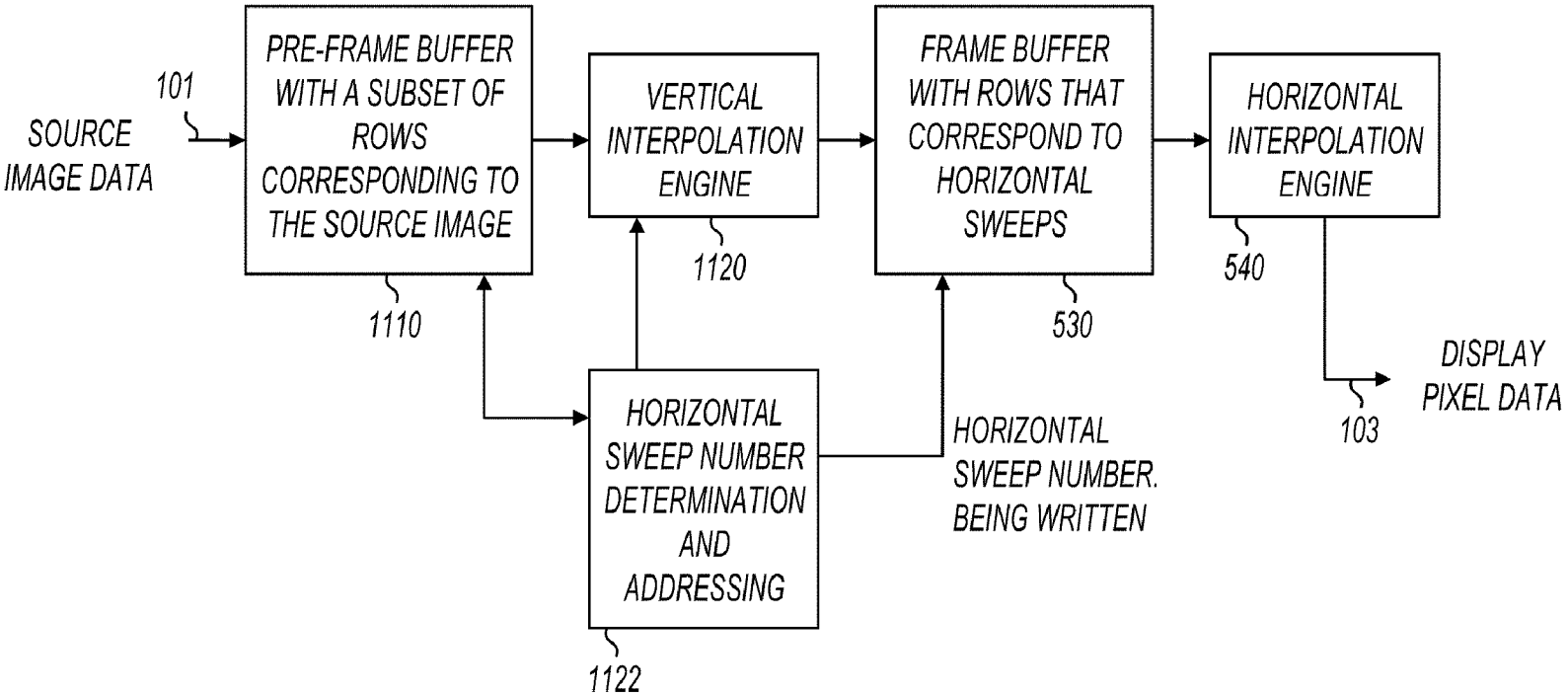
FIG. 11 shows buffers and interpolation components in accordance with various embodiments of the present invention.

FIG. 11 shows buffers and interpolation components in accordance with various embodiments of the present invention. FIG. 11 shows pre-frame buffer 1110, vertical interpolation engine 1120, horizontal sweep number determination and addressing component 1122, frame buffer 530, and horizontal interpolation engine 540.

In operation, pre-frame buffer 1110 receives source image data 101. Pre-frame buffer includes rows and columns of storage that correspond to pixels in the source image. Pre-frame buffer 1110 differs from pre-frame buffer 510 (FIG. 5) in that pre-frame buffer 1110 does not hold an entire source image. Rather, pre-frame buffer 1110 only holds a subset of rows of pixels from source image received at 101. For example, referring now to FIG. 12, pre-frame buffer 1110 includes different rows of the source image at different times.

In some embodiments, pre-frame buffer 1110 includes a first-in-first-out (FIFO) memory component capable of holding a subset of the source image. The number of rows held in pre-frame buffer 1110 may be small or large. In some embodiments, the number of rows held in pre-frame buffer 1110 is limited to the number necessary to vertically interpolate for a single horizontal sweep. In other embodiments, a sufficient number of rows are held in pre-frame buffer 1110 to vertically interpolate multiple horizontal sweeps.

In some embodiments, the source image data includes multiple frames of video data. In these embodiments, pre-frame buffer 1110 holds a subset of one image, or "frame" of the video data at a time. Also in some embodiments, pre-frame buffer 1110 is continuously updated as video data arrives, and data is retrieved from pre-frame buffer 1110 at a rate that allows vertical interpolation of entire frames before they are overwritten.

Vertical interpolation engine 1120 interpolates pixel data within individual columns of the source image to determine pixel values that lie on horizontal sweeps of the scan trajectory. Further, vertical interpolation engine 1120 interpolates for all horizontal sweeps that cross source image rows currently held in pre-frame buffer 1110. For example, referring to FIG. 12, a subset of source image rows are included in pre-frame buffer 1110 at time $T_1$. This subset of rows is crossed by horizontal sweeps in the first, second, third, and fourth vertical sweeps of the same image, corresponding roughly to horizontal sweeps 1-3, 18-20, 21-23, and 38-40. While at $T_1$, vertical interpolation engine 1120 interpolates for these horizontal sweeps and writes to the corresponding rows in frame buffer 530.

Figure 12:
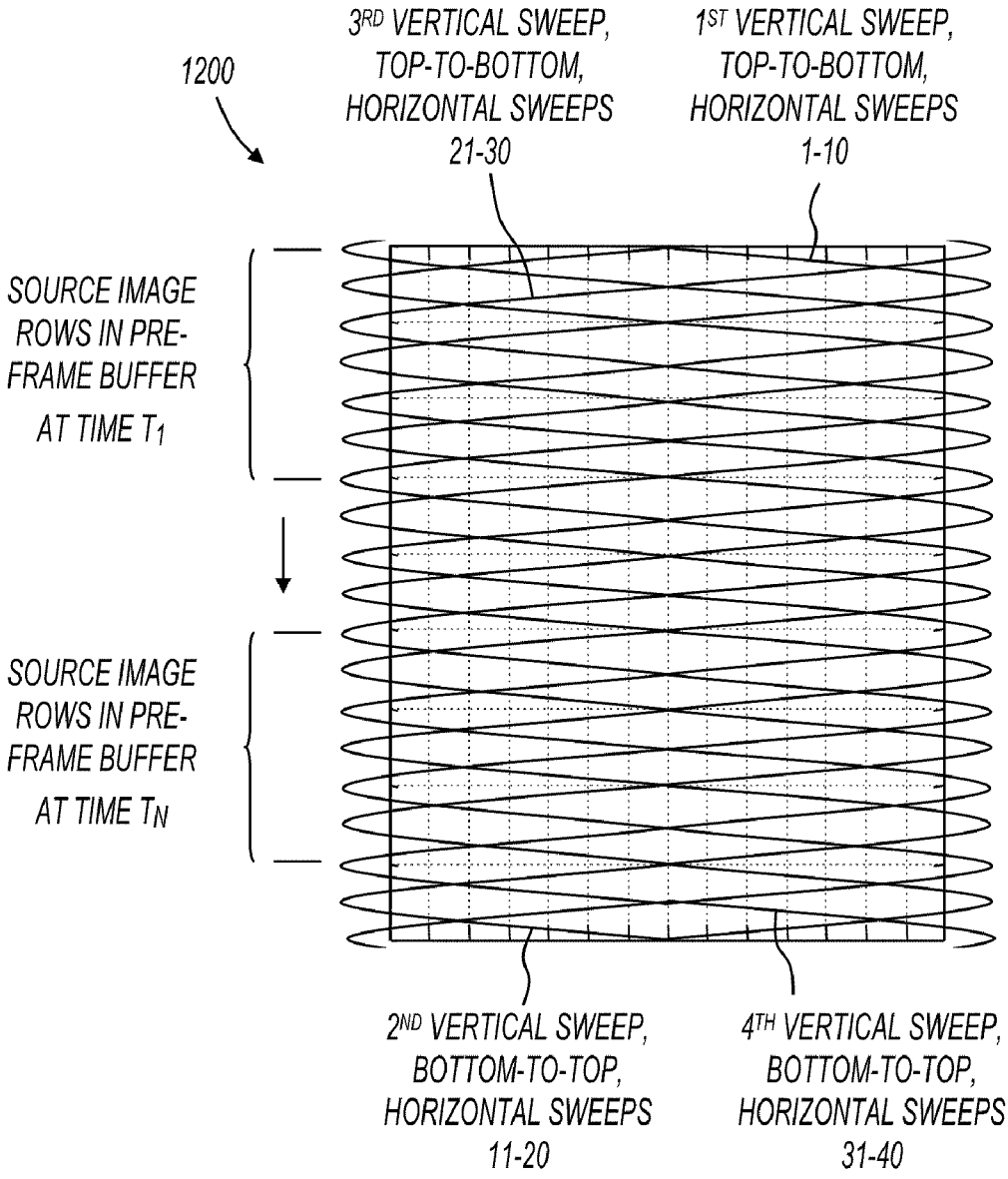
FIGS. 12 and 13 show scan trajectories in accordance with various embodiments of the present invention.

As time advances, the contents of pre-frame buffer 1110 represent a traversal of the source image. For example, as shown in FIG. 12, at time $T_N$, a different subset of source image rows are held in pre-frame buffer 1110, where $T_N$ is later than $T_1$. At time $T_N$, vertical interpolation component 1120 vertically interpolates for the horizontal sweeps that cross source image rows currently held in pre-frame buffer 1110.

Horizontal sweep number determination and addressing component 1122 determines which horizontal sweeps can be interpolated based on the contents of pre-frame buffer 1110. In some embodiments, component 1122 includes a lookup table that provides horizontal sweep numbers as a function of time or as a function of source image rows. For example, component 1122 may include a lookup table that returns horizontal sweep numbers 1-3, 18-20, 21-23, and 38-40 when provided with a lookup value that represents $T_1$. Also for example, component 1122 may include a lookup table that returns horizontal sweep numbers 1-3, 18-20, 21-23, and 38-40 when provided with a lookup value that represents one or more of the source image rows.

Frame buffer 530 includes rows that hold pixel data corresponding to horizontal sweeps of the scan trajectory. In some embodiments, the horizontal sweeps are written out-of-order. For example, at time $T_1$, rows 1-3, 18-20, 21-23, and 38-40 may be written, and then others rows may be written at later times. As described above, horizontal interpolation engine 540 retrieves row data from frame buffer 530, and interpolates within the row to determine display pixel data.

The various components in FIG. 11 may be implemented in any manner without departing from the scope of the present invention. For example, pre-frame buffer 1110 and frame buffer 530 may be memory devices such as random access memory. Also for example, interpolation engines 1120 and 540 may be implemented in hardware, software, or any combination. The various components may utilize processors, application specific integrated circuits (ASICs), or any other suitable means for implementing the functions described herein.

In some embodiments, the different interpolation operations may be performed at different times. For example, vertical interpolation engine 1110 may interpolate and fill frame buffer 530 as a video frame arrives, and horizontal interpolation engine 540 may interpolate only as display pixel values are needed as specified by the pixel clock. The pixel clock may or may not be periodic, and the displayed pixels may be dispersed linearly or nonlinearly along any one horizontal sweep.

Figure 13:
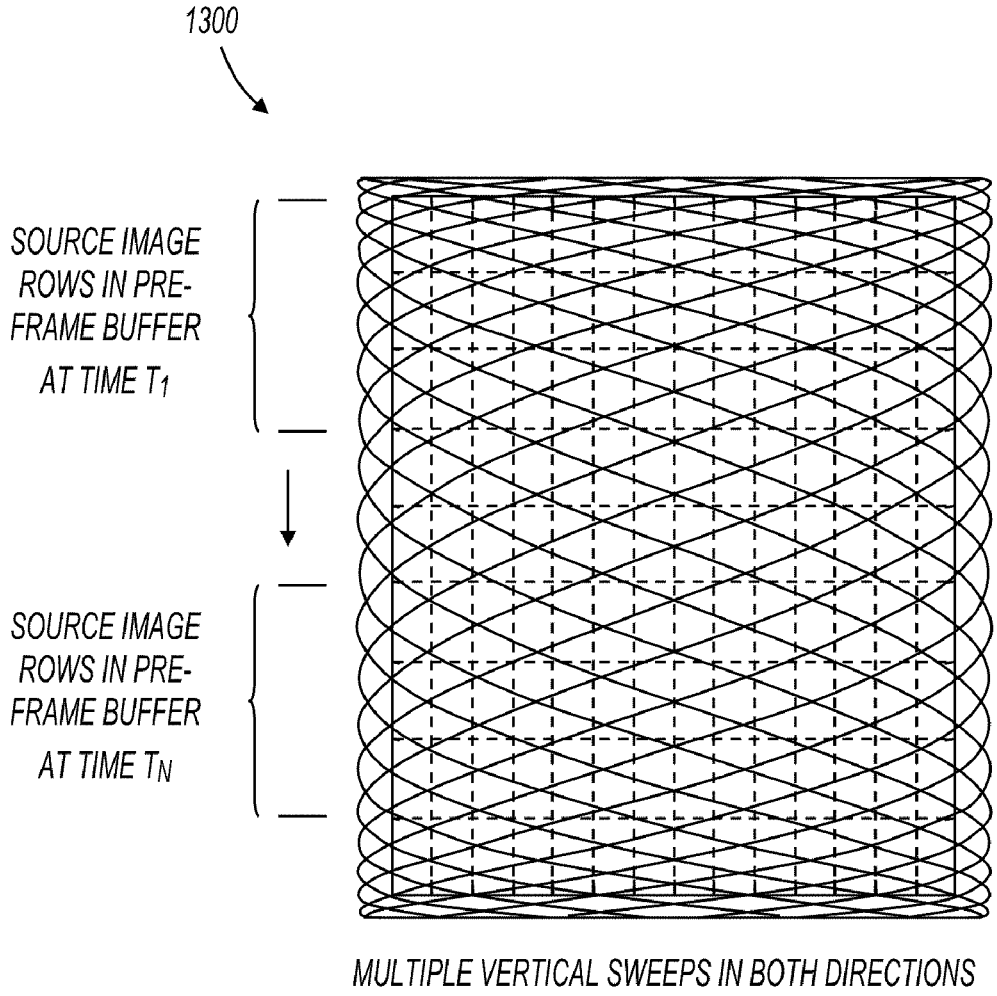

FIGS. 12 and 13 show scan trajectories in accordance with various embodiments of the present invention. Scan trajectory 1200 includes four vertical sweeps for each source image or video frame. For example, in some embodiments, the source image may be refreshed at 60 Hz, and the four vertical sweeps may occur sixty times each second. As described above with reference to FIG. 11, different portions of the various vertical sweeps may be vertically interpolated onto horizontal sweeps based on the contents of the pre-frame buffer.

Scan trajectory 1200 results from a sinusoidal horizontal trajectory and a linear vertical trajectory. Some embodiments include different trajectories. For example, scan trajectory 1300 (FIG. 13) results from sinusoidal trajectories in both vertical and horizontal dimensions. Similar to trajectory 1200, trajectory 1300 also includes multiple vertical sweeps for each source image or video frame. This is illustrated in FIG. 13 as different source image rows in the pre-frame buffer as time advances from $T_1$ to $T_N$. The various embodiments of the present invention may include any type or shape of scan trajectory. For example, any combination of linear and/or nonlinear (e.g., sinusoidal, sawtooth, triangular) may be employed in one or both of the vertical and horizontal dimensions.

Figure 14:
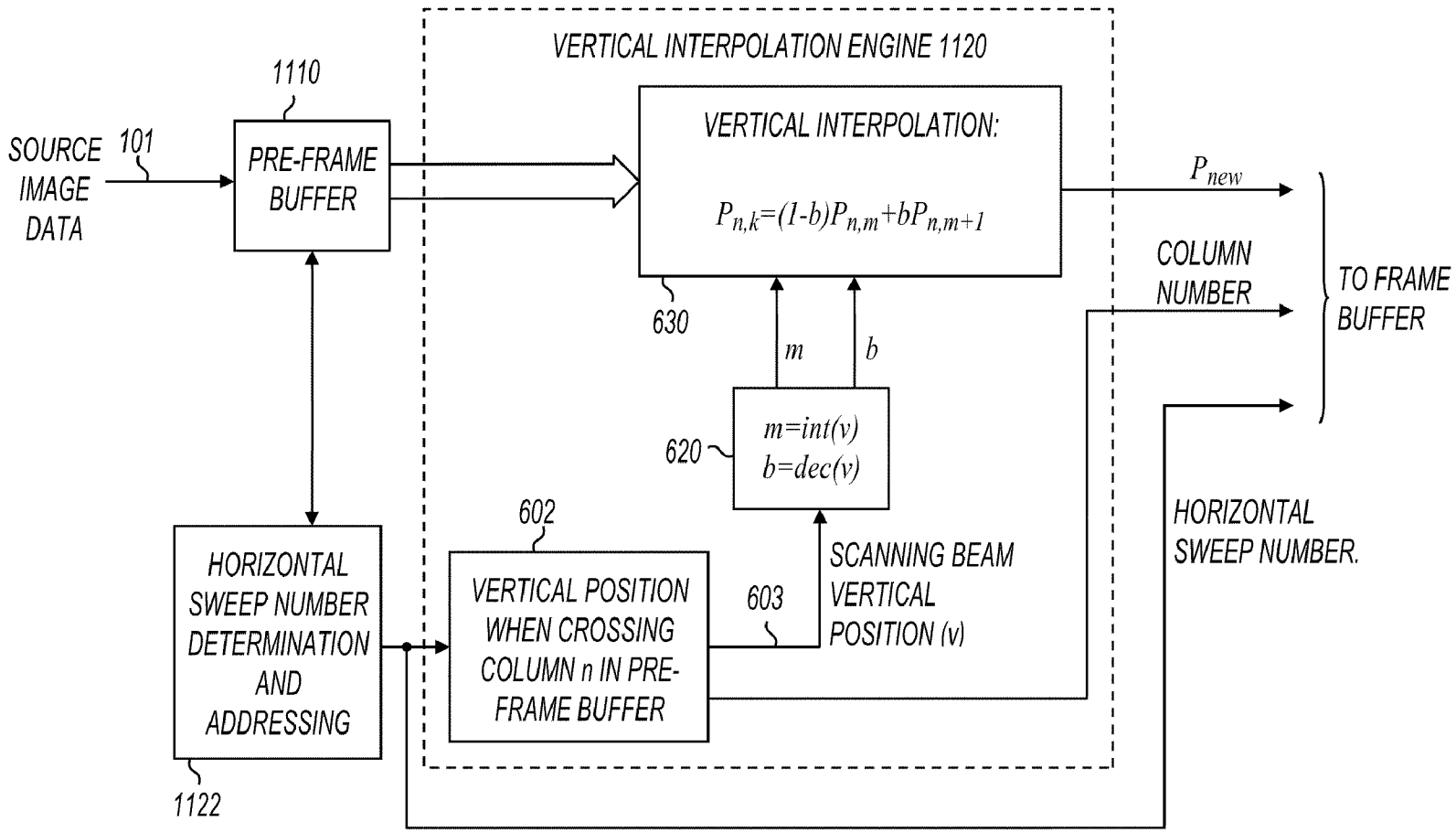
FIG. 14 shows buffers and interpolation components in accordance with various embodiments of the present invention.

FIG. 14 shows buffers and interpolation components in accordance with various embodiments of the present invention. Components shown in FIG. 14 are similar to those shown in FIG. 6, with the exception of horizontal sweep number determination and addressing component 1122. In operation, component 1122 determines a horizontal sweep onto which pixels will be vertically interpolated. As the contents of pre-frame buffer 1110 advance through the source image, component 1122 determines which horizontal sweeps that can be interpolated based on the current contents of pre-frame buffer 1110, and provides that information to vertical interpolation engine 1120 and the frame buffer. The horizontal sweep number is provided to component 602, which determines the vertical position as described above with reference to FIG. 6. The horizontal sweep number is also provided to the frame buffer as a partial address. The remainder of the address is the column number provided by component 602.

Figure 15:
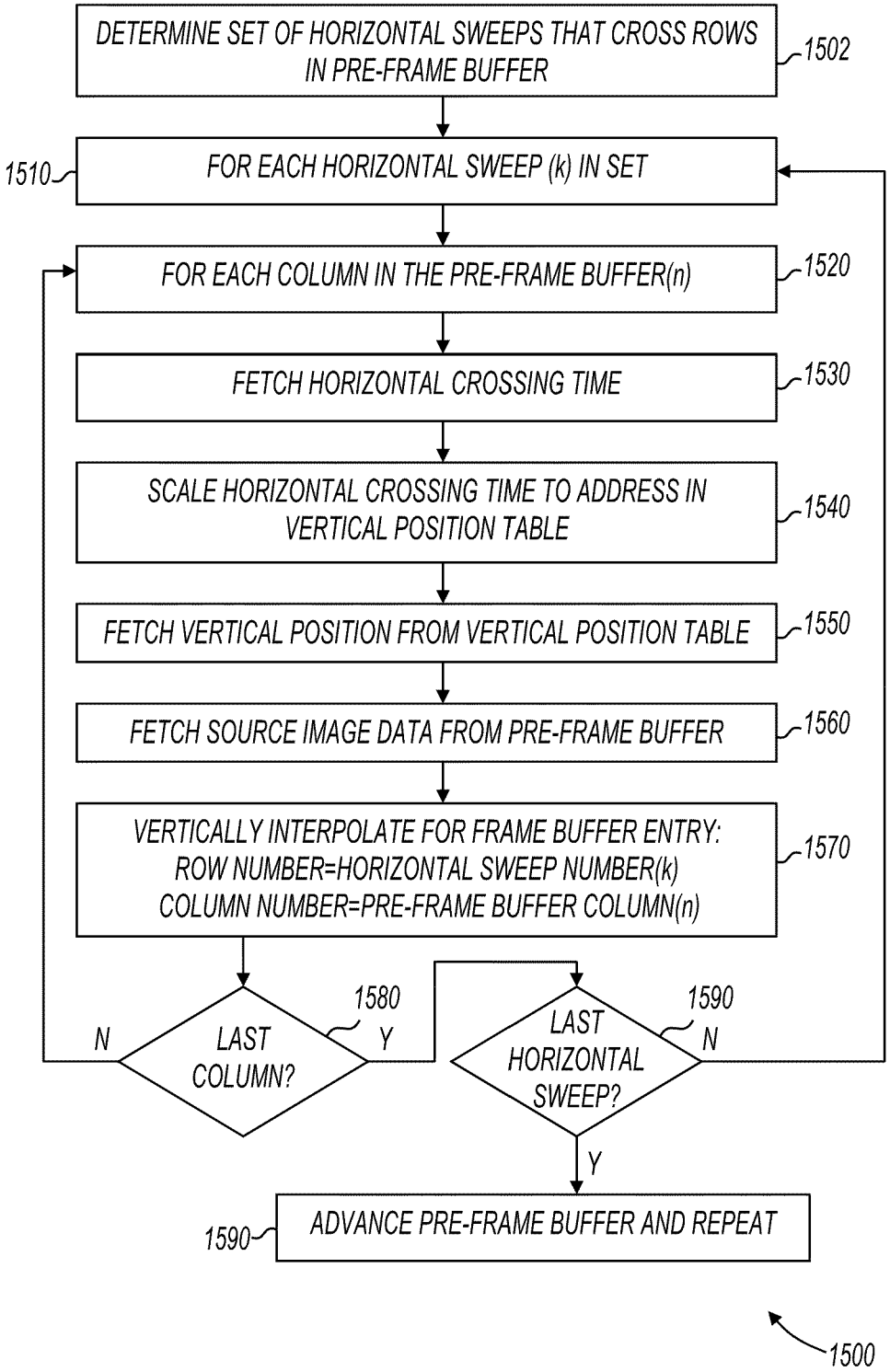
FIG. 15 shows a flow diagram of a method in accordance with various embodiments of the invention.

FIG. 15 shows a flow diagram of a method in accordance with various embodiments of the invention. In some embodiments, method 1500, or portions thereof, is performed by a scanning laser projector, embodiments of which are shown in previous figures. In other embodiments, method 1500 is performed by a series of circuits or an electronic system. Method 1500 is not limited by the particular type of apparatus performing the method. The various actions in method 1500 may be performed in the order presented, or may be performed in a different order. Further, in some embodiments, some actions listed in FIG. 15 are omitted from method 1500.

Method 1500 is shown beginning with block 1502. At 1502, the set of horizontal sweeps that cross source image rows in the pre-frame buffer are determined. Referring now back to FIGS. 11 and 14, horizontal sweep number determination and addressing component 1122 may include a lookup table that returns a set of horizontal sweeps that cross source image rows in the pre-frame buffer. All or a portion of each horizontal sweep in the set can be vertically interpolated onto based on the contents of the pre-frame buffer. As time advances, and the contents of the pre-frame buffer advance through the source image, vertical interpolation can be performed onto more and different horizontal sweeps.

As shown at 1510, the actions between 1510 and 1590 are performed for each horizontal sweep (k) of the set determined at 1502. As shown at 1520, the actions between 1520 and 1580 are performed for each column in the pre-frame buffer. At 1530, the time at which the horizontal sweep crosses the current pre-frame buffer column is determined. In some embodiments, this can simply be fetched from a table that has pre-computed values. In other embodiments, this horizontal crossing time is computed on the fly. In embodiments with a sinusoidal horizontal trajectory, the horizontal crossing time may be computed with an arcsine function.

At 1540, the horizontal crossing time is scaled to an address in a vertical position table, and at 1550, the vertical position is fetched from the vertical position table. As shown in FIG. 15, in some embodiments, the vertical position may be pre-computed and stored in lookup tables for fast access. In other embodiments, the vertical position may be computed on the fly. The actions of 1530, 1540, and 1550 correspond to the actions of component 602 (FIGS. 6, 14). At the completion of 1530, 1540, and 1550, the vertical position (v) of the current horizontal sweep (k) at the current column (n) is known.

At 1560, source image data is fetched from the pre-frame buffer. The source image data fetched from the pre-frame buffer is from a common column (n). Any number of pixels from column (n) may be fetched for use in vertical interpolation. At 1570, a frame buffer entry is determined by vertically interpolating pixel data from a single column of the pre-frame buffer. The frame buffer entry row number is the horizontal sweep number (k), and the frame buffer column number is the same as the pre-frame buffer column number (n).

Each time the inquiry at 1580 is satisfied, one row of the frame buffer has been filled with pixel data that lies on a single horizontal sweep. Further, when the inquiry at 1590 is satisfied, every frame buffer row corresponding to the horizontal sweeps determined at 1502 has been filled, and the vertical interpolation is complete for the current contents of the pre-frame buffer. The pre-frame buffer is advanced at 1590, and then method 1500 repeats to vertically interpolate onto more horizontal sweeps.

In some embodiments, method 1500 performs vertical interpolation for multiple vertical sweeps. For example, referring now back to FIG. 12, at time T1, component 1122 may (at 1502) determine the set of horizontal sweeps as 1-3, 18-20, 21-23, and 38-40. The order that the horizontal sweeps are interpolated may start with those at the top of the pre-frame buffer and advance downward. For example, the order may begin with horizontal sweeps 1, 20, 21, and 40, and then may continue with 2, 19, 22, and 30, and so on down the source image. In some embodiments, the pre-frame buffer is continuously updated one source image row at a time, and method 1500 operates continuously to vertically interpolate the contents of the pre-frame buffer onto horizontal sweeps. For example, component 1122 may always only return a subset of horizontal sweeps that cross the source image rows in the pre-frame buffer 1502. Once these horizontal sweeps are processed by the vertical interpolation engine, one or more rows of the pre-frame buffer may be updated, and then method 1500 repeats.

At the completion of vertical interpolation, the frame buffer includes rows of pixel data that lies on horizontal sweeps, and the display pixel data may be determined from data in the frame buffer as described above.

Figure 16:
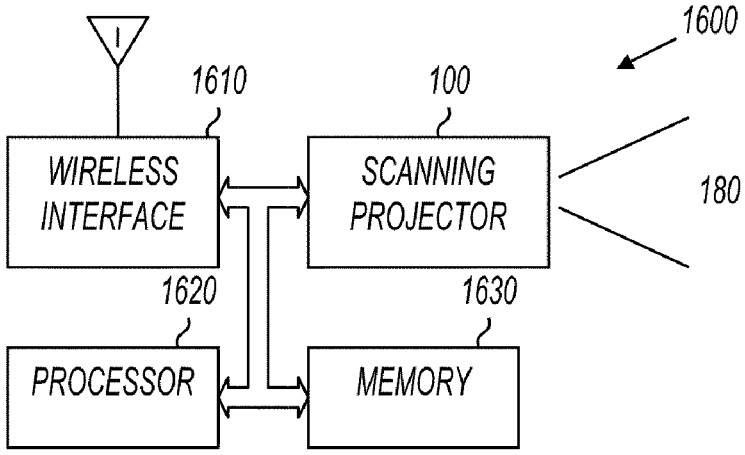
FIG. 16 shows a block diagram of a mobile device in accordance with various embodiments of the present invention.

FIG. 16 shows a block diagram of a mobile device in accordance with various embodiments of the present invention. As shown in FIG. 16, mobile device 1600 includes wireless interface 1610, processor 1620, memory 1630, and scanning projector 100. Scanning projector 100 paints a raster image at 180. Scanning projector 100 is described with reference to previous figures. In some embodiments, scanning projector 100 includes buffers and interpolation components such as those shown in, and described with reference to, earlier figures.

Scanning projector 100 may receive image data from any image source. For example, in some embodiments, scanning projector 100 includes memory that holds still images. In other embodiments, scanning projector 100 includes memory that includes video images. In still further embodiments, scanning projector 100 displays imagery received from external sources such as connectors, wireless interface 1610, or the like.

Wireless interface 1610 may include any wireless transmission and/or reception capabilities. For example, in some embodiments, wireless interface 1610 includes a network interface card (NIC) capable of communicating over a wireless network. Also for example, in some embodiments, wireless interface 1610 may include cellular telephone capabilities. In still further embodiments, wireless interface 1610 may include a global positioning system (GPS) receiver. One skilled in the art will understand that wireless interface 1610 may include any type of wireless communications capability without departing from the scope of the present invention.

Processor 1620 may be any type of processor capable of communicating with the various components in mobile device 1600. For example, processor 1620 may be an embedded processor available from application specific integrated circuit (ASIC) vendors, or may be a commercially available microprocessor. In some embodiments, processor 1620 provides image or video data to scanning projector 100. The image or video data may be retrieved from wireless interface 1610 or may be derived from data retrieved from wireless interface 1610. For example, through processor 1620, scanning projector 100 may display images or video received directly from wireless interface 1610. Also for example, processor 1620 may provide overlays to add to images and/or video received from wireless interface 1610, or may alter stored imagery based on data received from wireless interface 1610 (e.g., modifying a map display in GPS embodiments in which wireless interface 1610 provides location coordinates).

Figure 17:
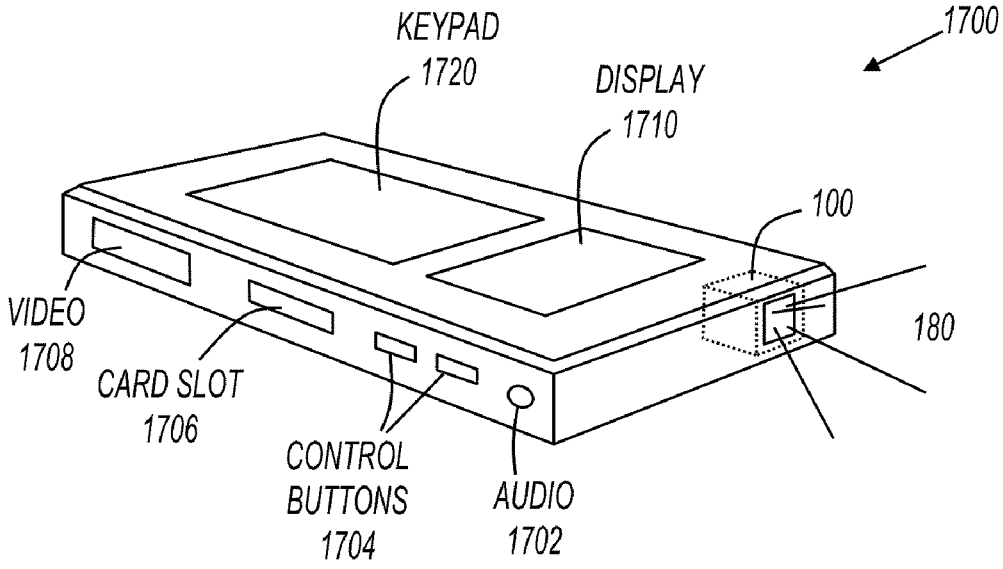
FIG. 17 shows a mobile device in accordance with various embodiments of the present invention.

FIG. 17 shows a mobile device in accordance with various embodiments of the present invention. Mobile device 1700 may be a hand held projection device with or without communications ability. For example, in some embodiments, mobile device 1700 may be a handheld projector with little or no other capabilities. Also for example, in some embodiments, mobile device 1700 may be a device usable for communications, including for example, a cellular phone, a smart phone, a personal digital assistant (PDA), a global positioning system (GPS) receiver, or the like. Further, mobile device 1700 may be connected to a larger network via a wireless (e.g., WiMax) or cellular connection, or this device can accept data messages or video content via an unregulated spectrum (e.g., WiFi) connection.

Mobile device 1700 includes scanning projector 100 to create an image with light at 180. Mobile device 1700 also includes many other types of circuitry; however, they are intentionally omitted from FIG. 17 for clarity.

Mobile device 1700 includes display 1710, keypad 1720, audio port 1702, control buttons 1704, card slot 1706, and audio/video (A/V) port 1708. None of these elements are essential. For example, mobile device 1700 may only include scanning projector 100 without any of display 1710, keypad 1720, audio port 1702, control buttons 1704, card slot 1706, or A/V port 1708. Some embodiments include a subset of these elements. For example, an accessory projector product may include scanning projector 100, control buttons 1704 and A/V port 1708.

Display 1710 may be any type of display. For example, in some embodiments, display 1710 includes a liquid crystal display (LCD) screen. Display 1710 may always display the same content projected at 180 or different content. For example, an accessory projector product may always display the same content, whereas a mobile phone embodiment may project one type of content at 1780 while display different content on display 1710. Keypad 1720 may be a phone keypad or any other type of keypad.

A/V port 1708 accepts and/or transmits video and/or audio signals. For example, A/V port 1708 may be a digital port that accepts a cable suitable to carry digital audio and video data. Further, A/V port 1708 may include RCA jacks to accept composite inputs. Still further, A/V port 1708 may include a VGA connector to accept analog video signals. In some embodiments, mobile device 1700 may be tethered to an external signal source through A/V port 1708, and mobile device 1700 may project content accepted through A/V port 1708. In other embodiments, mobile device 1700 may be an originator of content, and A/V port 1708 is used to transmit content to a different device.

Audio port 1702 provides audio signals. For example, in some embodiments, mobile device 1700 is a media player that can store and play audio and video. In these embodiments, the video may be projected at 180 and the audio may be output at audio port 1702. In other embodiments, mobile device 1700 may be an accessory projector that receives audio and video at A/V port 1708. In these embodiments, mobile device 1700 may project the video content at 180, and output the audio content at audio port 1702.

Mobile device 1700 also includes card slot 1706. In some embodiments, a memory card inserted in card slot 1706 may provide a source for audio to be output at audio port 1702 and/or video data to be projected at 180. Card slot 1706 may receive any type of solid state memory device, including for example, Multimedia Memory Cards (MMCs), Memory Stick DUOS, secure digital (SD) memory cards, and Smart Media cards. The foregoing list is meant to be exemplary, and not exhaustive.

Figure 18:
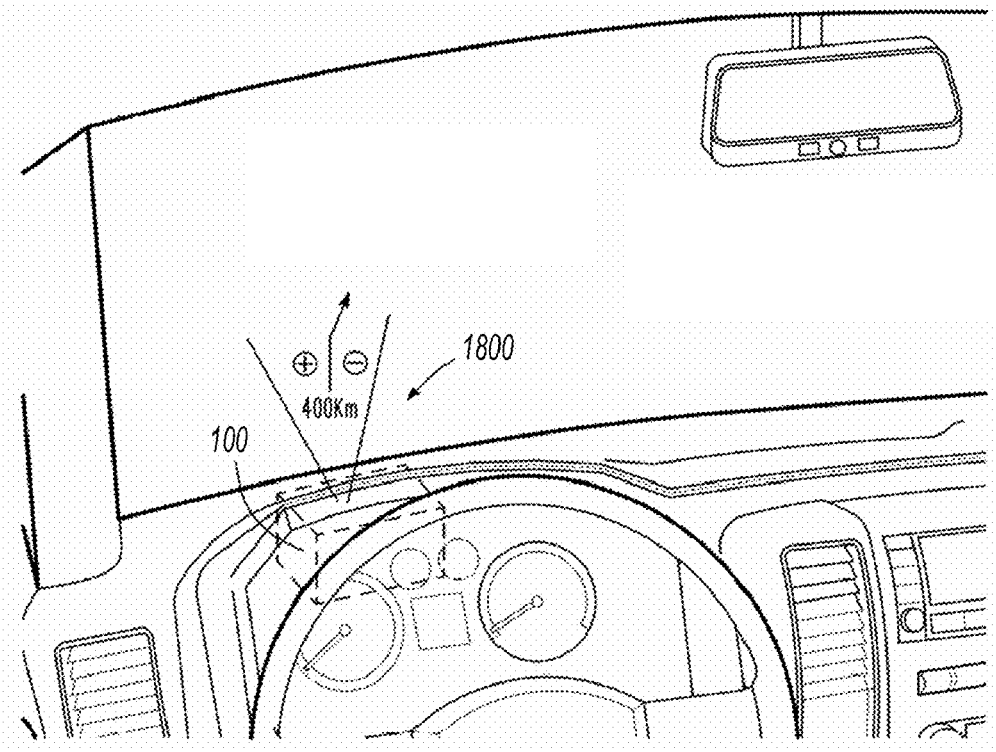
FIG. 18 shows a head-up display system in accordance with various embodiments of the invention.

FIG. 18 shows a head-up display system in accordance with various embodiments of the invention. Projector 100 is shown mounted in a vehicle dash to project the head-up display at 1800. Although an automotive head-up display is shown in FIG. 18, this is not a limitation of the present invention. For example, various embodiments of the invention include head-up displays in avionics application, air traffic control applications, and other applications.

Figure 19:
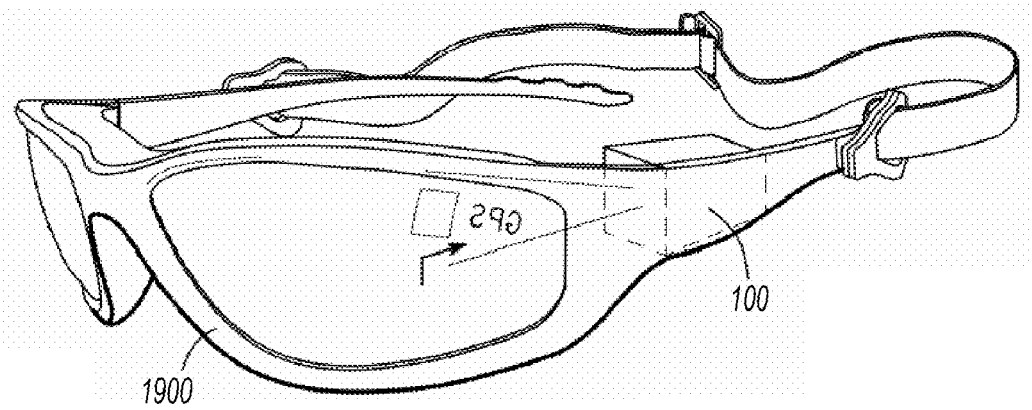
FIG. 19 shows eyewear in accordance with various embodiments of the invention.

FIG. 19 shows eyewear in accordance with various embodiments of the invention. Eyewear 1900 includes projector 100 to project a display in the eyewear's field of view. In some embodiments, eyewear 1900 is see-through and in other embodiments, eyewear 1900 is opaque. For example, eyewear may be used in an augmented reality application in which a wearer can see the display from projector 100 overlaid on the physical world. Also for example, eyewear may be used in a virtual reality application, in which a wearer's entire view is generated by projector 100. Although only one projector 100 is shown in FIG. 19, this is not a limitation of the present invention. For example, in some embodiments, eyewear 1900 includes two projectors; one for each eye.

Although the present invention has been described in conjunction with certain embodiments, it is to be understood that modifications and variations may be resorted to without departing from the scope of the invention as those skilled in the art readily understand. Such modifications and variations are considered to be within the scope of the invention and the appended claims.

What is claimed is:

1. A method comprising:

interpolating between vertically adjacent pixels in an image to determine pixel values on a nonlinear horizontal raster trajectory;

storing the pixel values on the nonlinear horizontal raster trajectory in a frame buffer; and interpolating between the pixel values in the frame buffer to determine display pixel values.

2. The method of claim 1 wherein interpolating between vertically adjacent pixels comprises:

determining a horizontal crossing time at which the nonlinear horizontal raster trajectory crosses a pixel column in the image;

determining a vertical position of the nonlinear horizontal raster trajectory at the horizontal crossing time; and interpolating between pixels above and below the vertical position.

3. The method of claim 2 wherein the horizontal crossing time is determined as an arcsine of the horizontal position of the pixel column.

4. The method of claim 3 wherein the vertical position is determined as a function of a vertical sweep rate.

5. The method of claim 1 wherein the nonlinear horizontal raster trajectory is substantially sinusoidal.

6. The method of claim 5 wherein the raster trajectory sweeps vertically at a substantially constant rate.

7. The method of claim 6 wherein interpolating between vertically adjacent pixels and storing pixel values in the frame buffer are performed for multiple vertical sweeps during a single vertical sweep.

8. The method of claim 1 further comprising driving a laser light source with the display pixel values.

9. An apparatus comprising:

a scanning mirror;

at least one laser light producing device to illuminate the scanning mirror;

a frame buffer having rows to hold pixel data corresponding to points on horizontal sweep trajectories of the scanning mirror;

a vertical interpolation engine to vertically interpolate source image data and to place vertically interpolated pixel data in rows of the frame buffer; and a horizontal interpolation engine to interpolate between pixel data within each row of the frame buffer to determine display pixel data to drive the at least one laser light producing device.

10. The apparatus of claim 9 further comprising a control circuit to source a single control signal to the scanning mirror to cause the scanning mirror to sweep on two axes.

11. The apparatus of claim 10 wherein the scanning mirror is resonant on a first axis.

12. The apparatus of claim 11 wherein the scanning mirror sweeps substantially linearly on a second axis.

13. The apparatus of claim 10 wherein the at least one laser light producing device comprises red, green, and blue laser light producing devices.

14. The apparatus of claim 9 wherein the vertical interpolation engine interpolates for a plurality of vertical sweeps of the scanning mirror for each frame of source image data.

15. A scanning laser projector comprising:

a scanning mirror that sweeps in a first dimension at a substantially linear rate and sweeps in a second dimension substantially sinusoidally;

a first interpolator to interpolate source image pixels in the first dimension resulting in rows of pixel data that correspond to points on sweeps of a beam in the second dimension reflected by the scanning mirror;

a frame buffer having a plurality of rows, each of the plurality of rows corresponding to pixel data on one sweep of the beam in the second dimension; and a second interpolator to interpolate pixel data in each row of the frame buffer to determine display pixel data as the beam sweeps in the second dimension.

16. The scanning laser projector of claim 15 wherein the first interpolator interpolates source image pixel data for multiple sweeps of the beam in the first dimension for each traversal of the source image pixels.

17. The scanning laser projector of claim 15 wherein the second interpolator interpolates pixel data while sweeping in one direction in the first dimension and while sweeping in an opposite direction in the first dimension.

18. a mobile device comprising:

a radio receiver;

a vertical interpolation engine to traverse source image data and to vertically interpolate pixel data onto a plurality of sinusoidal horizontal scanning trajectories for each frame of the source image data;

a frame buffer to hold frame buffer pixel data corresponding to the plurality of sinusoidal horizontal scanning trajectories for each frame of the source image data;

a horizontal interpolation engine to horizontally interpolate frame buffer pixel data corresponding to a first of the plurality of sinusoidal horizontal scanning trajectories during a first vertical sweep, and to horizontally interpolate frame buffer pixel data corresponding to a second of the plurality of sinusoidal horizontal scanning trajectories during a second vertical sweep;

at least one laser light source responsive to the horizontal interpolation engine; and a scanning mirror to reflect light from the at least one laser light source.

19. The mobile device of claim 18 wherein the mobile device comprises a mobile phone.

20. The mobile device of claim 18 wherein the mobile device comprises a global positioning system (GPS) receiver.

* * * * *